United States Patent [19]

DeCandia et al.

[11] 4,410,931

[45] Oct. 18, 1983

[54] RETENTION DEVICE FOR LIGHTING FIXTURE COVER

[75] Inventors: Giovanni DeCandia, Germantown; Edward B. Bilson, Memphis, both of Tenn.

[73] Assignee: International Telephone and Telegraph Corporation, New York, N.Y.

[21] Appl. No.: 304,819

[22] Filed: Sep. 23, 1981

[51] Int. Cl.[3] ..... F21J 29/00

[52] U.S. Cl. ..... 362/267; 362/223; 362/306; 362/307; 362/308; 362/311; 362/374; 362/375; 362/396; 362/455

[58] Field of Search ..... 362/267, 223, 306, 307, 362/308, 311, 374, 375, 396, 455

[56] References Cited

U.S. PATENT DOCUMENTS 3,720,432 3/1973 Chudler ..... 362/374

*Primary Examiner*—Stephen J. Lechert, Jr.

*Attorney, Agent, or Firm*—James B. Raden; Marvin M. Chaban

[57] ABSTRACT

A lighting fixture employing a cover or lens, preferably of flat glass or plastic. A slidable or pivotal retaining clip is provided for either opposite corners or for each corner of the cover. Each clip acts to hold the cover lens without the need for a surround frame. The retainer clips are slidable or pivotal between a hold position clamping the lens to the fixture body and a release position in which the fixture is freed of the retaining or clamping action of the clip. In the release position, the clip is held on the face of the fixture by holding stops on the fixture body.

9 Claims, 8 Drawing Figures

RETENTION DEVICE FOR LIGHTING FIXTURE COVER

BACKGROUND OF THE INVENTION

Lighting fixtures generally include a body faced with a lens or glass cover surrounded by a frame. Suitable retention means are provided on the fixture body to grip the frame and hold the cover in place. Over center linkages or latches are frequently used to snap and hold the cover frame against the fixture body. By operating the linkage to its open condition, the cover or lens may be opened or removed for replacement or to enable access to the fixture interior for replacement of the fixture lamp or other components.

Other fixtures employ a hinge at one end of the cover frame and a latch at the opposite end to enable opening and closure of the fixture cover or lens.

SUMMARY OF THE INVENTION

The present invention is directed to a lighting fixture having a frameless lens or refractor covering the fixture opening. To provide such a fixture which can be readily opened, we provide clips holding the cover along its rectangular edge surfaces. The clips in one form may be individually pivotal between a closed position holding the cover in a closed position and a released position in which the clip is free of engagement with the cover. In another form, each clip is individually slidable between the cover engaging position and an engagement free position, the clips being held on the fixture body in the engagement free position. Either two clips on the opposite corners of the housing or four clips at each corner are used.

It is therefore an object of the invention to provide an improved fixture closure apparatus which is adapted for use with a frameless glass or clear plastic cover.

It is a further object of the invention to provide an improved closure for a lighting fixture which employs spring action clips for holding the cover or closure in a closed position and which allows the cover to be opened when desired.

It is a still further object of the invention to provide a floodlight in which a rectangular front lens is tightly yet removably held to the housing by the use of two clamping members at opposite corners of the lens.

DETAILED DESCRIPTION

Figure 1:
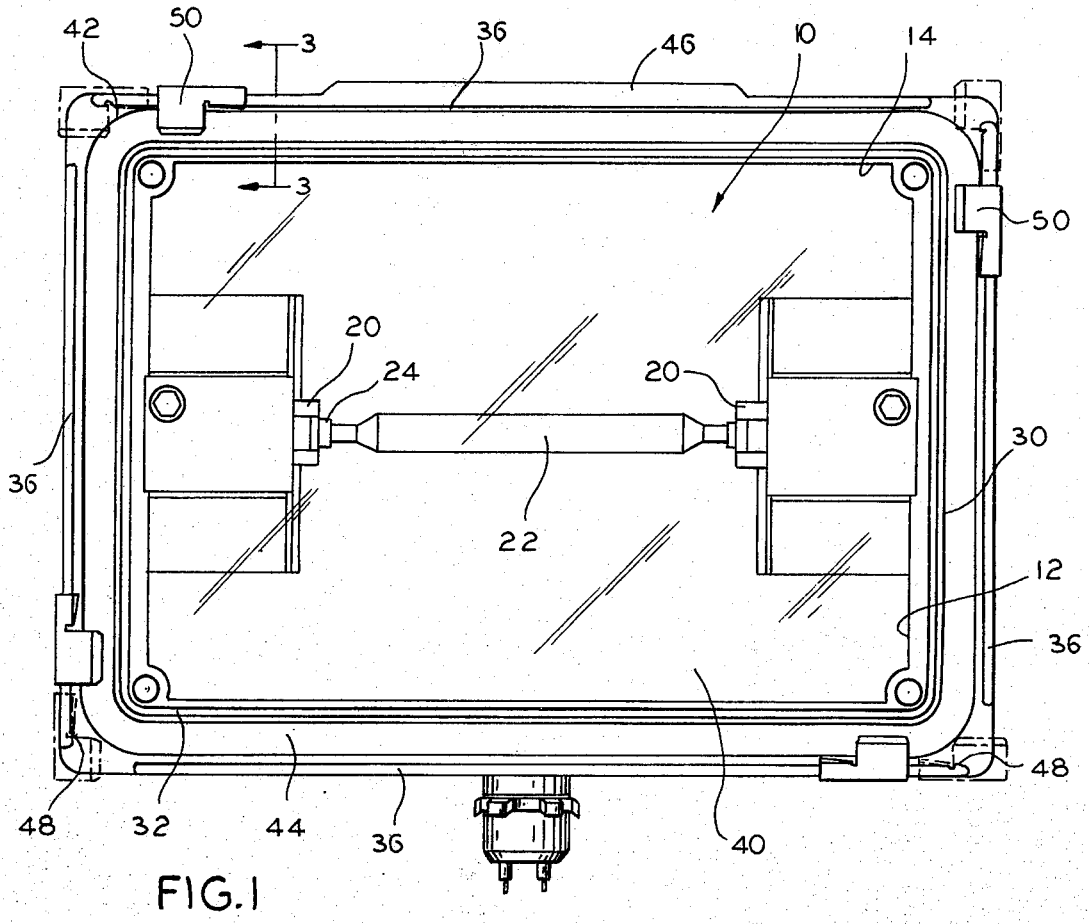
FIG. 1 is a front view in elevation of a lighting fixture employing my invention.

In FIG. 1, we show a lighting fixture 10 of a generally known type, such as that shown in U.S. Pat. No. 3,832,540, issued Aug. 27, 1974. In such a lighting fixture, there is an enclosing housing 12 which may be of suitably efficient heat transfer material such as cast aluminum or the like. The housing 12 has an essentially rectangular front face 14 from which the housing curves away to a curvilinear concave rear wall 16. Adjacent the rear wall 16 on the inside is a concave reflector 18 which is suitably affixed to the rear wall. The fixture as shown is a high intensity quartz floodlight. At the lateral sides of the housing within the fixture, there are two spaced apart sockets 20 for holding the respective ends of the high intensity lamp 22, the lamp being generally tubular with connectors 24 mating with the sockets at both lateral ends.

At the front face of the fixture, the stationary housing 12 defines the lamp opening with a planar peripheral rim 30. The rim 30 has a peripheral raised edge 32 as continuation of the wall of the housing leading outwardly to a channel recess 34 which in turn terminates in an upturned flange 36. The upturned flange 36 preferably extends through the midportion of the sides and terminates adjacent the corners of the housing, leaving a gap at each corner of the housing between the otherwise continuous flanges 36.

For enclosing the rectangular front face opening 14, a glass lens 40 of at least $\frac{1}{8}''$ thickness with rounded corners 42 is employed. A rigid clear plastic lens could also be used. No frame is required for the lens due to the use of the closure construction shown herein. The lens is sized to cover the housing front opening and is slightly smaller in area than the front area circumscribed by the flange 36 on top, bottom and sides.

Figure 2:
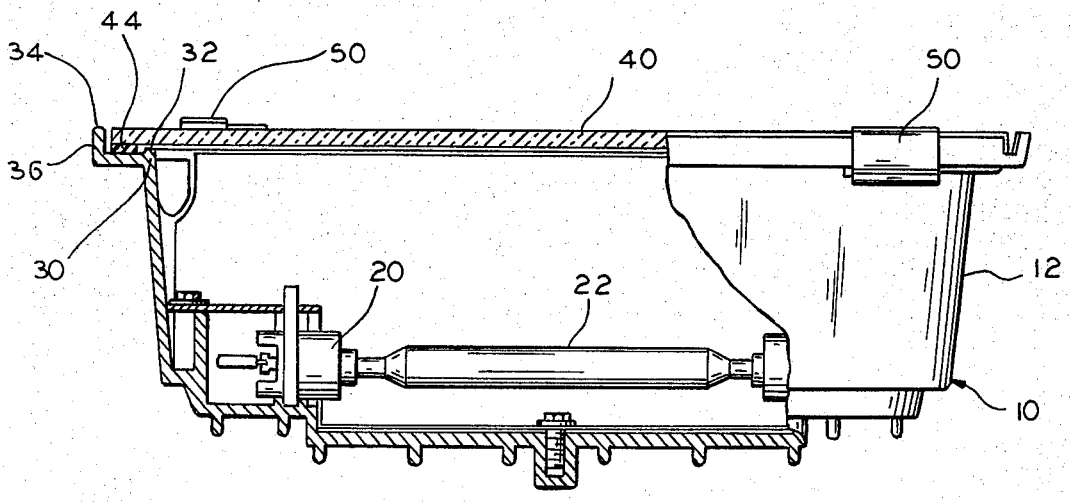
FIG. 2 is a side view in elevation, partially broken away to show the interior thereof, of the fixture of FIG. 1.
Figure 3:
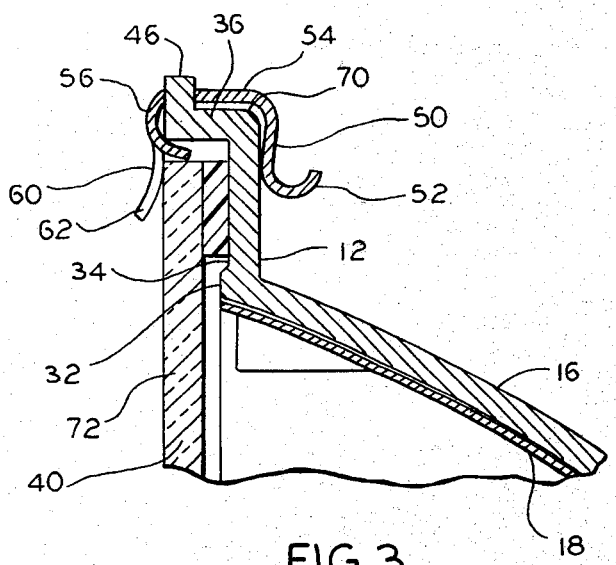
FIG. 3 is a partial view in section taken along lines 3—3 of FIG. 1.
Figure 4:
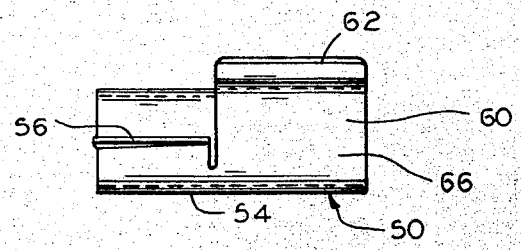
FIG. 4 is a front view in elevation of a typical clip as shown in FIG. 1.
Figure 5:
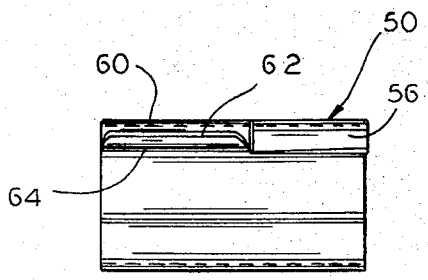
FIG. 5 is a bottom view in elevation of the clip of FIG. 4.

In FIG. 1 there can be seen through the flat translucent lens 40, the raised continuous rim 32 defining the extent of the walls of the fixture and the front opening. In FIGS. 2 and 3 there can be seen an outward channel recess 34 which carries a spongy resilient pressure sensitive gasket 44 of rectangular cross section. The gasket acts to cushion the edges of the lens and space the lens away from the raised rim. Thus, the thickness of the gasket 44 even when compressed must be greater than the height of the raised rim.

The outer flange 36 extends on all four sides of the housing and as mentioned is recessed at the corners of the housing. The flange acts as a limit stop to prevent movement of the lens away from the housing opening. Along the top edge, the flange 36 has an outwardly directed border 46 along the intermediate area thereof (see FIGS. 1 and 3).

Each flange 36 has an inwardly directed projection 48 at one end, there being four such projections 48 as seen best in FIG. 1.

Figure 6:
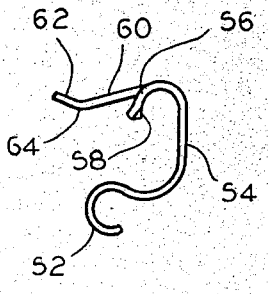
FIG. 6 is a right side view of the clip of FIG. 5.
Figure 7:
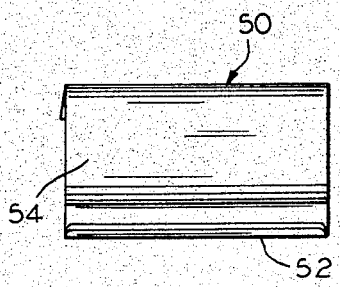
FIG. 7 is a rear view of the clip of FIG. 6.

To support the lens 40 on the front of the housing, four clips 50 are employed. A sample of one of these clips 50 is shown in detail in FIGS. 4–7. Each clip 50 is adapted to ride on the flange 36 of the housing as shown in FIG. 1. Each clip 50 is essentially S-shaped (FIG. 6) and has a mounting portion adapted to ride on the flange and a depending lens holding finger.

The clip 50 of FIGS. 4–7 is formed of material such as spring tempered stainless steel. In section, the clip has a rolled edge 52 seen in cross section (FIG. 6) as a section of cylindrical tube. The clip 50 further extends annularly through a flatted back support section 54 to a recurved section 56 which extends along approximately one half of the length of the clip. The innermost edge of the recurved section 56 is deflected inwardly at corner tip 58, for reasons which will be explained subsequently.

Adjacent the recurved section 56, the clip has an extending finger 60 with an upturned outer edge surface 62, a contact line 64 being defined at the juncture of the finger body 66 and the upturned edge surface 62.

A clip 50 is mounted on the housing flange 36 with one clip on each flange. As mounted on the flange (see FIG. 3) the rolled edge 52 rests on the backside 70 of the flange with the flatted back 54 resting along the outside of the flange height. The recurved section 56 rests inside the flange terminating in the channel recess 34 adjacent the gasket 44. The finger 60 rests in the plane of the lens outer surface 72. The clip 50 is slidable from a lens retaining position as shown in solid lines in FIG. 1 to a lens release position shown in dashed lines in FIG. 1. With the clip in the lens retaining position, the clip is inward of the corner of the housing with the finger overlying the corner of the lens. By sliding the clip outwardly, the clip finger may be positioned out of contact with the rounded corner 42 of the lens defining the lens release position, enabling removal of the lens.

The projection 48 on the outer edge of the flange 36 serves as a stop to impede and prevent further outward movement of the clip by engaging the inturned tip 58 of the recurved section. In this way, a clip once mounted on the housing flange is slidable to the extent allowed by the flange projection and therefore cannot fall off or readily be removed from the housing. The spring tension of the clip holds the lens tightly in place by its engagement with the lens outer surface 72 with the clip in the retaining position. Four such clips 50 are provided, each being individually slidable between the release position and the lens retaining position.

Figure 8:
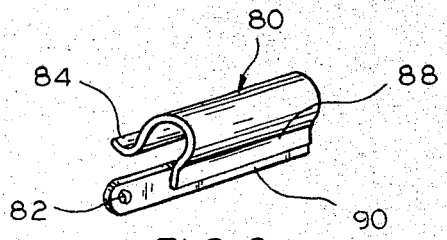
FIG. 8 is a perspective view seen from the rear thereof of a clip showing a second embodiment of the invention.

In FIG. 8, we show an alternative type of clip 80 in which the clip has a rivet opening 82 to enable the clip to be riveted to the housing. The clip of FIG. 8 has much the same shape as the clip of FIGS. 3–7 including lens gripping finger 84 a recurved position, a flat flange resting section 88 and an outer flat or rolled edge 90. The clip 80 of FIG. 8 is pivoted between its lens retaining position and a release position angularly disposed to release the engagement with the lens. Four clips would again be provided one adjacent each corner, each clip mounted by a rivet through a suitable opening in the flange wall.

We have found that where the cover lens is glass of suitable thickness, we can hold the glass lens sufficiently tight using only two clips. The rigidity of the glass lens combined with the resilience of the gasket 44 produce a fluid tight seal for the lamp housing and sufficient holding force for the glass cover. Preferably the clips slidable on horizontal edges of the cover lens are used. The lower clip prevents the cover lens from sliding down under the effect of gravity with the flanges providing limit stops to prevent the lens from falling off the housing in the event of unforeseen external conditions.

We note that a suitable gasket for use with the two clip arrangements is one of medium hard silicone sponge gasket material. The glass lens used for the two clip arrangements may be of $\frac{1}{8}''$ thickness. A suitable spring clip nay be 26 gauge spring tempered stainless steel. These materials are also suitable for use with the four clip arrangement described.

We claim:

1. In a lighting fixture, retention apparatus for holding a translucent rimless refractor lens tightly against a main housing of the fixture, said apparatus comprising an integral ridge on the face of the housing externally of an area abutting an opening inset in the face of the housing to be covered by said lens, said retention apparatus including a resilient clip member mating with said ridge for holding said clip member on said housing with said clip member being slidable along said ridge, an inturned finger on said clip member, said finger biased to engage the outer surface of the lens and hold the lens tightly against the housing in the luminaire operative condition, a stop member on said ridge adapted to stop the slide of said clip member with said finger free of engagement with the outer surface of the lens to enable removal of the lens in an inoperative condition of the luminaire.

2. In a lighting fixture as claimed in claim 1 in which said cover lens comprises a planar sheet resting essentially vertically when covering said opening and in which there is a resilient gasket surrounding said opening for engaging the inner surface of the sheet in a fluid tight seal.

3. In a lighting fixture as claimed in claim 1, in which said clip member in section is generally recurved into a shape generally approximating an "S" with said lens engaging finger extending from one extremity of said "S" shape and in which there is an inturned ear on said clip member adapted to engage the stop member to prevent removal of the clip member from the fixture housing.

4. In a lighting fixture as claimed in claim 2 in which there are two clip members at opposite corners of the opening for holding said sheet tightly against said gasket and housing.

5. In a lighting fixture as claimed in claim 1, in which the housing has a generally rectangular opening to be covered by said cover and in which each side of the rectangular opening has a like ridge and in which there is a clip member mounted on each ridge and in which there is a separate stop member on each ridge.

6. A totally enclosed luminaire comprising in combination, an enclosing housing, a refractor lens and a closure device for holding said lens on said housing, in which said housing comprises a plurality of closure walls about a generally vertical, substantially rectangular face opening, a peripheral flange of said housing framing said opening a recess within said framing flange with said recess surrounding the opening, a depressible gasket within said recess surrounding the opening, said lens comprising a generally planar translucent rigid sheet sized to cover said opening with the periphery of the sheet inwardly of said flange and said sheet covering the extent of the gasket within said recess, and said closure device comprising a plurality of clips spaced about the periphery of said sheet to form the sole means for holding said lens on said housing, each of said clips comprising a formed spring member individually movable from a first position compressing said sheet against said gasket into retaining relation for tightly holding said lens in covering relation to said opening to a second position outwardly of the periphery of the sheet, whereby with all said spring members in the second position said sheet is released from the combined holding of said clips and said sheet may be withdrawn from said housing, and in which each said spring member comprises a lens gripping finger adapted to rest against an outer surface of the lens with the spring member in its first position and each spring member comprising an arcuate section extending about said ridge into a gripping relation with a wall of said housing.

7. A luminaire as claimed in claim 6, in which each spring member includes a recurved section adapted to rest externally of the periphery of the sheet and within the flanged recess with the spring member in the first position whereby to confine said spring member for sliding movement along said flange.

8. A luminaire as claimed in claim 6, in which there is a raised continuous rim about said opening at the inner border of the recess, and in which said gasket spaces the lens sheet away from the raised rim with said spring members in their first positions.

9. A luminaire as claimed in claim 6, in which said luminaire with said spring members in their first position comprises a fluid tight structure with said lens and gasket enclosing the opening in a fluid tight condition.

* * * * *

US004410931B1

REEXAMINATION CERTIFICATE (3341st)

United States Patent [19] [11] B1 4,410,931

DeCandia et al. [45] Certificate Issued Oct. 7, 1997

[54] RETENTION DEVICE FOR LIGHTING FIXTURE COVER

[75] Inventors: Giovanni DeCandia, Germantown; Edward B. Bilson, Memphis, both of Tenn.

[73] Assignee: FL Industries, Inc., Livingston, N.J.

Reexamination Request:
No. 90/003,935, Aug. 23, 1995

Reexamination Certificate for:

| | |
|---|---|
| Patent No.: | **4,410,931** |
| Issued: | **Oct. 18, 1983** |
| Appl. No.: | **304,819** |
| Filed: | **Sep. 23, 1981** |

[51] Int. Cl.[6] ..... F21V 31/00

[52] U.S. Cl. ..... 362/267; 362/223; 362/306; 362/307; 362/308; 362/311; 362/374; 362/375; 362/396; 362/455

[58] Field of Search ..... 362/267, 223, 362/306, 307, 308, 311, 374, 375, 396, 455

[56] References Cited

U.S. PATENT DOCUMENTS 3,720,432 3/1973 Chudler ..... 362/365 X

OTHER PUBLICATIONS

Brochure—Thomas Luminaire "Lighting Classics" (Plaintiff's Exhibit 53) 1972, 3 sheets.

7 photograph sheets, Thomas Luminaire (Plaintiff's Exhibit 54).

*Primary Examiner*—Stephen F. Husar

[57] ABSTRACT

A lighting fixture employing a cover or lens, preferably of flat glass or plastic. A slidable or pivotal retaining clip is provided for either opposite corners or for each corner of the cover. Each clip acts to hold the cover lens without the need for a surround frame. The retainer clips are slidable or pivotal between a hold position clamping the lens to the fixture body and a release position in which the fixture is freed of the retaining or clamping action of the clip. In the release position, the clip is held on the face of the fixture by holding stops on the fixture body.

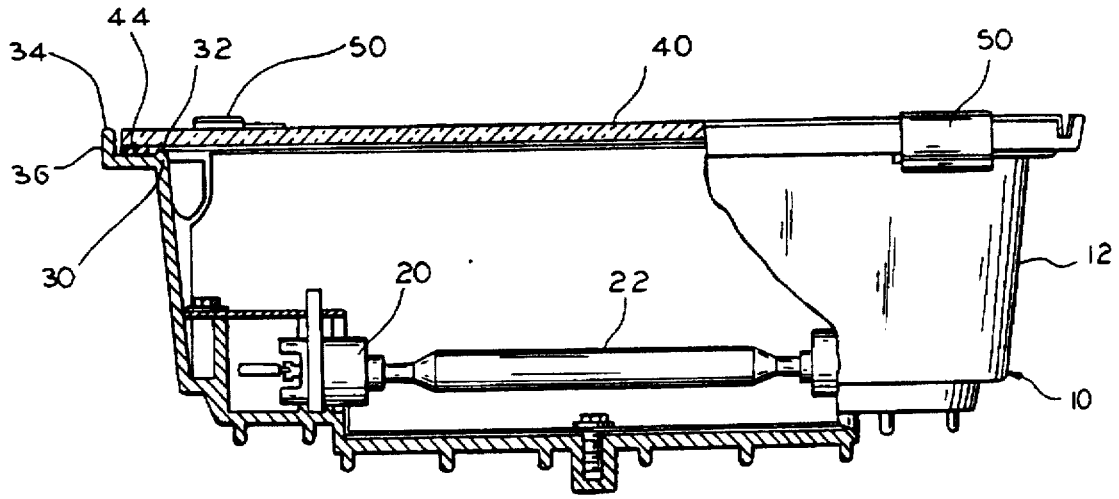

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–5 is confirmed.

Claim 6 is determined to be patentable as amended.

Claims 7–9, dependent on an amended claim, are determined to be patentable.

New claims 10–17 are added and determined to be patentable.

6. A totally enclosed luminaire *for outdoor use* comprising in combination, an enclosing housing, *a high intensity lamp mounted within the housing,* a refractor lens and a closure device for holding said lens on said housing, in which said housing comprises a plurality of closure walls about a generally vertical, substantially rectangular face opening, a peripheral flange of said housing framing said opening, a recess within said framing flange with said recess surrounding the opening, a depressible gasket within said recess surrounding the opening, said lens comprising a generally planar translucent rigid *glass* sheet sized to cover said opening with the periphery of the sheet inwardly of said flange and said sheet covering the extent of the gasket within said recess, and said closure device comprising a plurality of clips spaced about the periphery of said sheet to form the sole means for holding said lens on said housing, each of said clips comprising a formed spring member individually movable from a first position compressing said sheet against said gasket into retaining relation for tightly holding said lens in covering relation to said opening to a second position outwardly of the periphery of the sheet, whereby with all said spring members in the second position said sheet is released from the combined holding of said clips and said sheet may be withdrawn from said housing, and in which each said spring member comprises a lens gripping finger adapted to rest against an outer surface of the lens with the spring member in its first position and each spring member comprising an arcuate section extending about said [ridge] *flange* into a gripping relation with a wall of said housing.

*10. The luminaire as claimed in claim 6 wherein said rigid glass sheet is tempered glass.*

*11. The luminaire as claimed in claim 6 wherein said high intensity lamp is a quartz halogen lamp.*

*12. A totally enclosed outdoor quartz halogen luminaire comprising in combination, an enclosing housing, a refractor lens and a closure device for holding said lens on said housing, in which said housing comprises a plurality of closure walls about a generally vertical, substantially rectangular face opening, a peripheral flange of said housing framing said opening, a recess within said framing flange with said recess surrounding the opening, a high intensity quartz halogen lamp mounted on said housing within said closure walls, a depressible gasket within said recess surrounding the opening, said lens comprising a flat, translucent, rigid glass sheet of generally rectangular configuration, said sheet being sized to cover said opening with the periphery of the sheet extending slightly inwardly of said flange and said sheet covering the extent of the gasket within said recess, and said closure device comprising a plurality of clips spaced about the periphery of said sheet to form the sole means for holding said lens on said housing, each of said clips comprising a formed spring member individually movable from a first position compressing said sheet against said gasket into retaining relation for tightly holding said lens in covering relation to said opening to a second position outwardly of the periphery of the sheet, whereby with all said spring members in the second position said sheet is released from the combined holding of said clips and said sheet may be withdrawn from said housing, and in which each said spring member comprises a lens gripping finger adapted to rest against an outer surface of the lens with the spring member in its first position and each spring member comprising an arcuate section extending about said flange into a gripping relation with a wall of said housing.*

*13. The luminaire as claimed in claim 12, wherein corners of said glass sheet are rounded.*

*14. The luminaire as claimed in claim 12, wherein said clips are slidably mounted on said housing flange.*

*15. The luminaire as claimed in claim 14, wherein said clips include means mounting said clips to said housing flange which permit slidable movement to said second position with said clips being secured to said flange during said movement.*

*16. The luminaire as claimed in claim 12, wherein said clips are pivotally mounted on said housing.*

*17. The luminaire as claimed in claim 16, wherein said clips include means mounting said clips to said housing which permits pivotal movement of said clips from said first position to said second position, such that in said second position said clips are disposed angularly to said housing.*

* * * * *